US010533338B2

(12) United States Patent
Blomgren et al.

(10) Patent No.: US 10,533,338 B2
(45) Date of Patent: Jan. 14, 2020

(54) CONNECTOR FOR USE IN INTER-PANEL CONNECTION BETWEEN SHEAR WALL ELEMENTS

(71) Applicants: Hans-Erik Blomgren, Vashon, WA (US); James Daniel Dolan, Pullman, WA (US)

(72) Inventors: Hans-Erik Blomgren, Vashon, WA (US); James Daniel Dolan, Pullman, WA (US)

(73) Assignee: Katerra, Inc., Menlo Park, CA (US)

( * ) Notice: Subject to any disclaimer, the term of this patent is extended or adjusted under 35 U.S.C. 154(b) by 0 days.

(21) Appl. No.: 15/801,237

(22) Filed: Nov. 1, 2017

(65) Prior Publication Data

US 2018/0328067 A1 Nov. 15, 2018

Related U.S. Application Data

(60) Provisional application No. 62/505,036, filed on May 11, 2017.

(51) Int. Cl.

| | |
|---|---|
| ***E04H 9/02*** | (2006.01) |
| ***E04H 9/14*** | (2006.01) |
| ***E04C 5/06*** | (2006.01) |
| ***E04C 5/02*** | (2006.01) |
| ***E04C 3/18*** | (2006.01) |

(52) U.S. Cl.

CPC ..... *E04H 9/021* (2013.01); *E04C 3/18* (2013.01); *E04C 5/02* (2013.01); *E04C 5/06* (2013.01); *E04H 9/14* (2013.01)

(58) Field of Classification Search

CPC ..... E04C 3/18; E04C 5/02; E04C 5/06; E04C 5/0645; E04H 9/021; E04H 9/14

See application file for complete search history.

(56) References Cited

U.S. PATENT DOCUMENTS

| | | | | |
|---|---|---|---|---|
| 1,402,304 A * | 1/1922 | Lord | ..... | A47G 1/105 160/381 |
| 1,858,221 A * | 5/1932 | Siegfried | ..... | E04F 13/04 52/354 |
| 2,868,146 A * | 1/1959 | Mackintosh | ..... | E04B 1/2604 52/639 |

(Continued)

FOREIGN PATENT DOCUMENTS

| | | | | |
|---|---|---|---|---|
| CN | 105442721 A | 3/2016 | | |
| GB | 292817 A * | 6/1928 | ..... | E04B 1/2604 |

(Continued)

OTHER PUBLICATIONS

Pacific Earthquake Engineering Center, "Tall Building Initiative: Guidelines for Performance-Based Seismic Design of Tall Buildings", Version 2.00 released Apr. 2017 (Year: 2017).*

(Continued)

*Primary Examiner* — James M Ference

(74) *Attorney, Agent, or Firm* — Elliott, Ostrander & Preston, P.C.

(57) ABSTRACT

An apparatus to connect two mass timber (CLT, LVL, or other configurations) shear wall panels, comprising a high load deformation capacity steel connector, wherein the connector comprises a high stiffness that shifts to a low stiffness during a high intensity earthquake or significant wind loading event.

18 Claims, 9 Drawing Sheets

(56) References Cited

U.S. PATENT DOCUMENTS 2,877,520 A * 3/1959 Jureit ..... E04C 3/292 100/913
3,011,226 A * 12/1961 Menge ..... F16B 15/0046 411/466
3,016,586 A * 1/1962 Atkins ..... F16B 15/0046 411/466
3,090,088 A * 5/1963 Wood ..... F16B 15/0046 248/217.3
3,172,171 A * 3/1965 Knight ..... E04B 1/49 411/458
3,241,424 A * 3/1966 Moehlenpah ..... F16B 15/0046 411/466
3,266,362 A * 8/1966 Carr ..... F16B 15/0046 411/466
3,322,017 A * 5/1967 Dufficy ..... F16B 15/0046 411/466
3,390,902 A * 7/1968 Jureit ..... F16B 15/0046 403/68
3,427,055 A * 2/1969 Coovert ..... F16B 15/0046 217/65
3,454,292 A * 7/1969 Sanford ..... E04B 1/49 403/283
3,479,783 A * 11/1969 Jureit ..... F16B 15/0046 52/639
3,494,645 A * 2/1970 Jureit ..... F16B 15/0046 403/DIG. 15
3,498,170 A * 3/1970 Sanford ..... F16B 15/0038 411/468
3,731,583 A * 5/1973 Jureit ..... F16B 15/0046 411/466
3,841,194 A * 10/1974 Moehlenpah ..... F16B 15/0046 411/466
3,841,195 A * 10/1974 Jureit ..... F16B 15/0046 29/432
4,318,652 A * 3/1982 Gore ..... F16B 15/0046 411/468
4,586,550 A * 5/1986 Kitipornchai ..... E04C 3/18 144/344
4,710,083 A * 12/1987 Wolf ..... E04B 1/49 403/283
4,737,060 A * 4/1988 Birckhead ..... B21D 53/38 403/DIG. 15
4,794,746 A * 1/1989 Ramer ..... E04B 5/12 52/695
4,819,394 A * 4/1989 Compton ..... E04B 1/215 52/252
4,887,952 A * 12/1989 Wolf ..... E04B 1/49 411/466
5,655,756 A * 8/1997 Robinson ..... E04H 9/022 267/140.2
5,706,626 A * 1/1998 Mueller ..... E04C 2/384 52/656.2
5,833,421 A * 11/1998 Lees ..... B21D 31/02 411/466
5,862,638 A * 1/1999 Holland ..... E04H 9/022 248/562
5,896,716 A * 4/1999 Jalla ..... E04C 3/18 411/466
5,966,892 A * 10/1999 Platt ..... E04B 1/26 403/386
6,012,256 A * 1/2000 Aschheim ..... E04B 1/24 52/167.1
6,014,843 A * 1/2000 Crumley ..... E04H 9/02 403/300
6,047,503 A * 4/2000 Kost ..... E04B 1/10 52/79.9
6,098,969 A * 8/2000 Nagarajaiah ..... F16F 15/04 248/550
6,158,184 A * 12/2000 Timmerman, Sr. ... E04B 1/0007 52/293.3
6,203,232 B1 * 3/2001 Ward ..... F16B 15/0046 403/14
6,237,300 B1 * 5/2001 Carne ..... E04B 2/58 52/281
6,237,303 B1 * 5/2001 Allen ..... E04B 1/2403 52/653.1
6,546,689 B1 * 4/2003 Kim ..... E04B 1/48 52/698
8,297,023 B2 * 10/2012 Collins ..... E04B 1/24 403/169
9,234,350 B1 * 1/2016 Gilbert ..... E04C 3/36
9,528,265 B1 * 12/2016 Gilbert ..... E04C 3/36
9,719,257 B2 * 8/2017 Gilbert ..... E04C 3/29
2002/0095275 A1 * 7/2002 Anzai ..... E04G 23/0218 703/1
2002/0095879 A1 * 7/2002 Fanucci ..... E04H 9/02 52/167.3
2002/0100229 A1 * 8/2002 Chen ..... E04B 1/2403 52/167.1
2003/0009964 A1 * 1/2003 Trarup ..... E02D 27/32 52/295
2003/0136075 A1 * 7/2003 Brackett ..... E04B 1/26 52/712
2003/0208985 A1 * 11/2003 Allen ..... E04B 1/2403 52/653.1
2005/0257451 A1 * 11/2005 Pryor ..... E04B 1/2403 52/167.4
2006/0037256 A1 * 2/2006 Pryor ..... E04B 2/707 52/167.1
2007/0186503 A1 * 8/2007 Homma ..... E04B 1/2604 52/655.1
2008/0148681 A1 * 6/2008 Hiriyur ..... E04B 1/2403 52/690
2010/0107519 A1 * 5/2010 Reaveley ..... E04H 9/02 52/167.4
2010/0319271 A1 * 12/2010 Sarraf ..... E01D 19/02 52/98
2012/0017523 A1 * 1/2012 Ozaki ..... E04H 9/02 52/167.1
2013/0019545 A1 * 1/2013 Buchanan ..... E04B 1/10 52/167.1
2013/0074427 A1 * 3/2013 Kawai ..... E04H 9/021 52/167.4
2015/0013240 A1 * 1/2015 Malakauskas ..... E04B 1/34869 52/79.9

FOREIGN PATENT DOCUMENTS

WO 2016046796 A2 3/2016
WO WO-2016185432 A1 * 11/2016 ..... E04H 9/021
WO WO-2017017563 A1 * 2/2017 ..... E04B 1/2604

OTHER PUBLICATIONS

Amini, M.O., Van De Lindt, J.W., Rammer, D., Pei, S., Line, P., Popovski, M., "Determination of Seismic Performance Factors for CLT Shear Wall Systems"; (2016) World Conference on Timber Engineering, Vienna, AT.

Schneider, J., Stiemer, S.F., Tesfamariam, S., Karacabeyli, E., Popovski, M., "Damage Assessment of Cross Laminated Timber Connections Subjected to Simulated Earthquake Loads"; (2012) World Conference on Timber Engineering, Auckland, NZ.

Scotta, R., Marchi, L., Trutalli, D., Pozza, L., "A Dissipative Connector for CLT Buildings: Concept, Design, and Testing"; Materials (2016), 9, 139, pp. 1-17, MDPI, Basel , Switzerland.

* cited by examiner

FRONT VIEW

200

PERSPECTIVE VIEW

200

600

800

900

1000

CONNECTOR FOR USE IN INTER-PANEL CONNECTION BETWEEN SHEAR WALL ELEMENTS

RELATED APPLICATIONS

This application claims the benefit of the filing date of U.S. provisional patent application No. 62/505,036, filed May 11, 2017, entitled "Connector for Inter-panel Connections between Shear Wall Elements", the entire contents of which are incorporated by reference under 37 C.F.R. § 1.57.

This application is related to U.S. patent application Ser. No. 15/786,141, filed Oct. 17, 2017 entitled "Method and Apparatus to Minimize and Control Damage to a Shear Wall Panel Subject to a Loading Event", the entire contents of which are incorporated by reference under 37 C.F.R. § 1.57.

TECHNICAL FIELD

Embodiments of the invention relate to building products. In particular, embodiments of the invention relate to a connector to connect a shear wall to an adjacent shear wall in a single or multistory building.

BACKGROUND

A factor behind the increasing use of mass timber panels, such as Cross-Laminated Timber (CLT) panels, vertically laminated veneer (LVL) panels, and parallel strand lumber (PSL) panels, in construction projects is the accelerated construction timeline compared to using traditional building materials and processes. When designed correctly, it is possible to erect an entire structure for a multiple story building in a matter of weeks instead of months. An additional factor that is driving the increased demand for mass timber panels in building projects is the difference in types of on-site field labor required. Erection of a structure using mass timber panels requires carpenters or general laborers, while traditional multiple story building projects that use concrete and steel construction require concrete finishers and iron workers typically at higher labor rates than carpenters and general laborers. Finally, the environmental benefit of sequestered carbon associated with timber construction versus steel and concrete construction, and the utilization of small-diameter trees in mass timber panels, provides additional motivation to use mass timber panel in construction projects.

One of the current issues in using mass timber panels in low-rise to mid-rise buildings is the lack of information associated with the performance of such panels in regions with higher seismic hazard. While quantifying the seismic design parameters for mass timber panel-based buildings is progressing in the building industry, currently there are no inter-panel connectors that are qualified or certified for use in high seismic regions other than standard hardware bolt-, nail, or screw-type connectors. Most of the connectors used in current construction of mass timber panel-based building projects are not capable of handling the reversed cyclic load deformations associated with earthquakes. Mass timber panels are relatively stiff and thus energy dissipation must be accomplished through the ductile behavior of connections between different shear wall elements. Therefore, new high load deformation capacity-connectors that provide high ductility/hysteretic energy dissipation are needed to achieve acceptable performance of mass timber panel-based buildings during events such as earthquakes and high wind loads.

BRIEF DESCRIPTION OF THE DRAWINGS

Embodiments are illustrated by way of example, and not by way of limitation, and can be more fully understood with reference to the following detailed description when considered in connection with the figures in which.

DETAILED DESCRIPTION

Embodiments of the invention involve a connector to join two mass timber shear wall panels (or simply "mass timber panels") that performs acceptably during a seismic event such as an earthquake or high wind load. Embodiments of the connector should be easy to install, and easily replaced after the building experiences a seismic event, to allow the building to be more easily erected and easier to repair following the seismic event. In one embodiment of the invention, the connector has high initial stiffness to minimize wall racking displacement under low and moderate intensity earthquakes. (Racking resistance of wood shear walls is a major factor in determining the response of the shear walls to wind and seismic forces; the less resistance, the greater the racking displacement. When a wall panel is subjected to a racking force, the connectors distort, and the racking force imposes a horizontal displacement on the lateral system).

Figure 6:
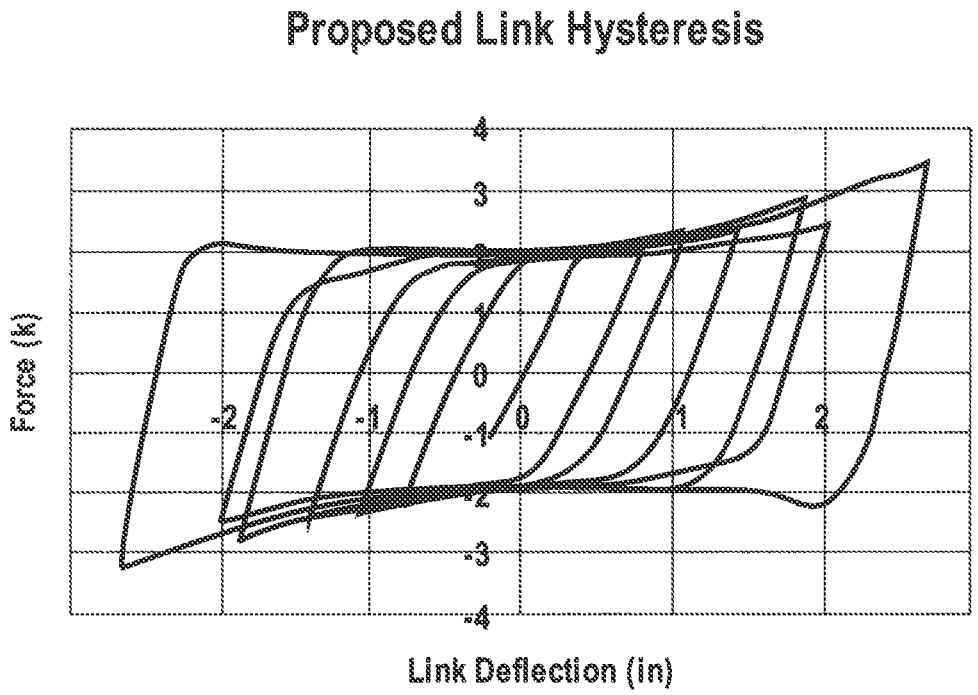
FIG. 6 illustrates a load-deflection curve for a hysteretic response curve in accordance with an embodiment of the invention.

One embodiment of the invention achieves a clearly defined load at which the stiffness of the connector changes from a high initial stiffness to a low stiffness to allow high displacement capacity of a wall comprising mass timber shear panels when the building is subjected to a significant seismic event. The clearly defined load is the proportional limit of the connector where the linear-elastic yield strain of metal is attained and beyond which non-linear inelastic strains develop. In one embodiment, the ideal performance of the connector yields an elastic (reversible)-plastic (irreversible) load-deflection curve for an envelope curve. A representative curve is illustrated in the chart 600 of FIG. 6. This curve was generated in a nonlinear numerical model of one embodiment of the connector during a cyclic racking (shear) deformation. The elastic range can be seen by viewing the straight line that begins at the origin of the chart and is a straight line up into the upper right quadrant of the graph. The proportional limit for the connector as modelled is at a force level of about 2 kips. From there the inelastic (flat horizontal line) range is achieved. (An object in a plastic deformation range will first have undergone elastic deformation, which is reversible, so the object will return part way to its original shape). Embodiments of the invention further should have the ability to sustain large displacements without metal fatigue, fracture, or unstable buckling to provide drift (lateral displacement/story height) capacity of 4-6%. Finally, embodiments of the invention should have hysteresis loops as large as possible, as illustrated in chart 600 in FIG. 6, with a minimum of pinching, in order to maximize their capacity for energy dissipation. The hysteretic energy dissipation is a measure of the area contained within the full loop of the curves as depicted in chart 600 in FIG. 6.

In structural engineering, a shear wall is a structural system composed of rigid wall panels (also known as shear panels) to counter the effects of in-plane lateral load acting on a structure. Wind and seismic loads are the most common loads that shear walls are designed to carry. Under several building codes, including the International Building Code (where it is called a bearing or frame wall line) the designer is responsible for engineering an appropriate quantity, length, and arrangement of shear wall lines in both orthogonal directions of the building to safely resist the imposed lateral loads. Shear walls can located along the exterior of the building, within the interior of the building or a combination of both.

Plywood sheathing is the conventional material used in wood (timber) stud framed shear walls, but with advances in technology and modern building methods, other prefabricated options have made it possible to insert multi-story shear panel assemblies into narrow openings within the building floor plate or at the exterior face of the floor plate. Mass timber shear panels in the place of structural plywood in shear walls has proved to provide stronger seismic resistance.

With reference to FIGS. 1A, 1B, 1C and 1D, in one embodiment 100, one or more ductile/dissipative inter-mass timber panel connectors (e.g., plates 101A and/or 101B) fasten a minimum of two mass timber wall panels 105A and 105B together along their respective abutted vertical edges 106A and 106B. The connectors 101 are suitable for use in platform- or balloon-framed mass timber construction methods. When subjected to actions from service level earthquake and less than ultimate wind events, the connector 101 is designed to maintain elastic stiffness so that adjacent panels 105 act, or move, together as a rigid or single body. When subjected to actions from design (Building Code Level), Risk-Targeted Maximum Considered Earthquake ($MCE_R$) events, or ultimate wind events, the connector 101 achieves a low stiffness plastic state which allows each individual wall panel 105A, 105B to rotate (rock) about a respective base point 110A, 110B resulting in a lower stiffness deformation controlled system suitable for seismic regions.

Figure 1A:
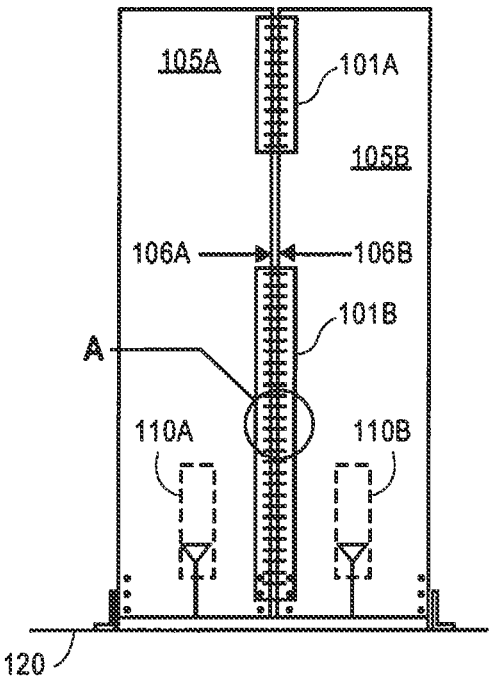
FIG. 1A illustrates an elevation view of two mass timber wall panels interconnected according to an embodiment of the invention.
Figure 1B:
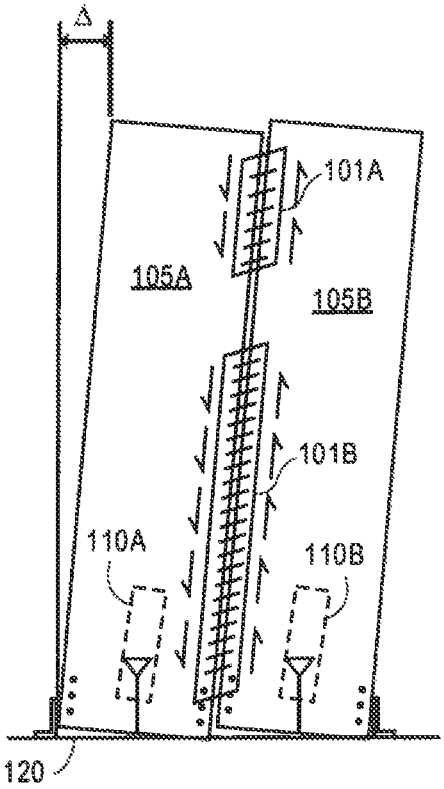
FIG. 1B illustrates an elevation view of two mass timber wall panels interconnected according to an embodiment of the invention.
Figure 1C:
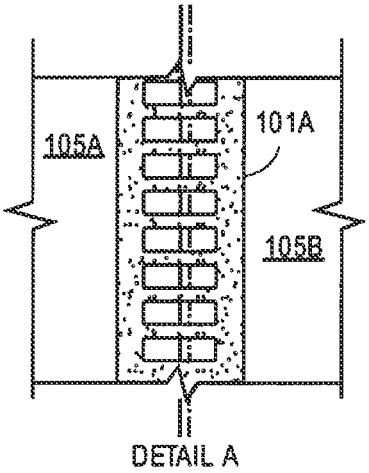
FIG. 1C illustrates an elevation view of two mass timber wall panels interconnected according to an embodiment of the invention.
Figure 1D:
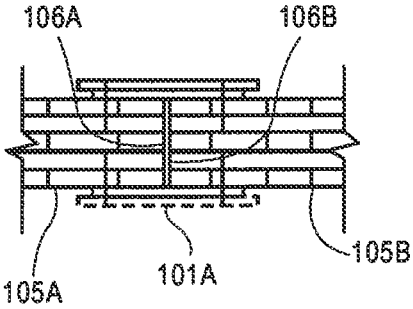
FIG. 1D illustrates an top view of two mass timber wall panels interconnected according to an embodiment of the invention.

The mass timber wall panels 105A, 105B stand on a base support 120, e.g., a top edge of a lower story wall (such as a mass timber panel), or a foundation, for example, a foundation wall, a ground level floor, or upper story floor. The mass timber wall panels 105A, 105B are each connected to the base support 120 by a respective tie-down 110A, 110B. In one embodiment, the wall panels extend vertically one or more stories or levels from base support 120. Generally speaking, in one embodiment, the wall panels are rectangular, with dimensions greater in height than in width. In one embodiment, the wall panels 105A, 105B are centrally supported on base support 120 at the location of a tie-down 110A, 110B. In other words, each wall panel 105A, 105B is coupled to the base support 120 by a tie-down 110A, 110B, and the tie down is located equidistant from the left and right vertical edges of the wall panel. Essentially, the wall panel is balanced on the supporting tie-down. During a low intensity seismic or other loading event the adjacent wall panels can rock to one side or the other, and back again as a rigid unit (as illustrated in FIG. 1B), under the influence of an imposed cyclic lateral or horizontal force. During a high intensity seismic or other loading event the adjacent wall panels can rock to one side or the other, and back again in an independent manner, under the influence of lateral or horizontal force. In either case, wall panels rock from side to side about their point of attachment to the base support, that is, about their respective tie-downs to the base support. The independent wall rocking allows for motion dampening/energy dissipation at the inter-wall panel connectors, as discussed below.

A "service level earthquake", or service level earthquake shaking, may be defined as ground shaking represented by an elastic, 2.5%-damped, acceleration response spectrum that has a mean return period of 43 years, approximately equivalent to a 50% exceedance probability in 30 years. As for "ultimate wind events", over the years, wind speed maps have changed from fastest mile to 3-second gust and then to "ultimate" 3-second gust wind speeds. A comparison of American Society of Civil Engineers (ASCE) 7-93 (fastest mile) wind speeds, ASCE 7-05 (3-second gust) ASD wind speeds, and ASCE 7-10 (3-second gust) ultimate wind speeds is provided in Table C26.5-6 of the ASCE 7-10 commentary.

Figure 7A:
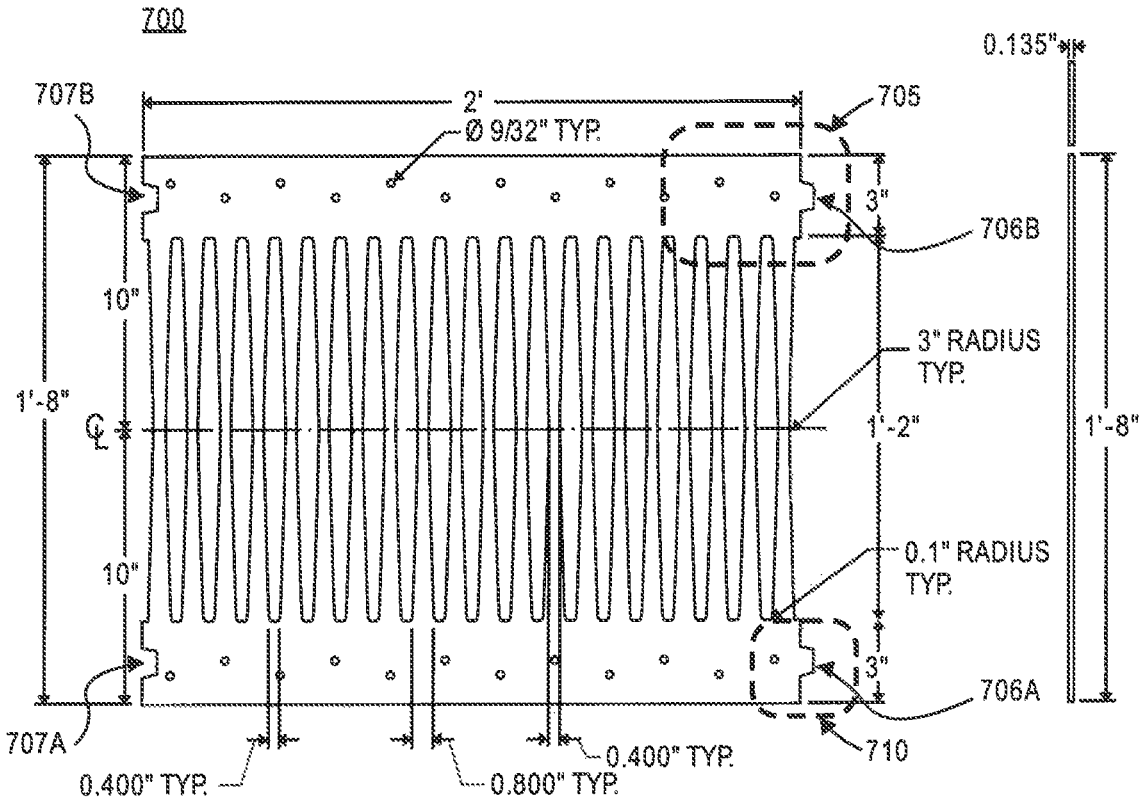
FIGS. 7A, 7B and 7C illustrate various aspects of an embodiment of the invention.

Regarding the embodiment illustrated in FIGS. 1A-1D, it is understood that one connector 101 may be larger or smaller, and the various length, width, depth/plate thickness dimensions of the connector may vary according to different embodiments, for example, the number of connectors installed between two adjacent wall panels, the height, width, thickness, and weight of the wall panels, etc., without departing from embodiments of the invention. FIG. 7A illustrates a connector in accordance with an embodiment of the invention 700 and as dimensioned, fabricated and tested by the assignee of the present invention. The connector was dimensioned and fabricated for easy handling and installation in 2 foot sections.

Figure 7B:
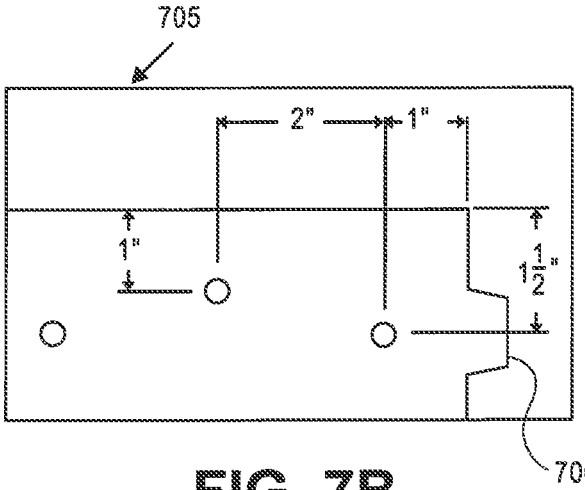
Figure 7C:
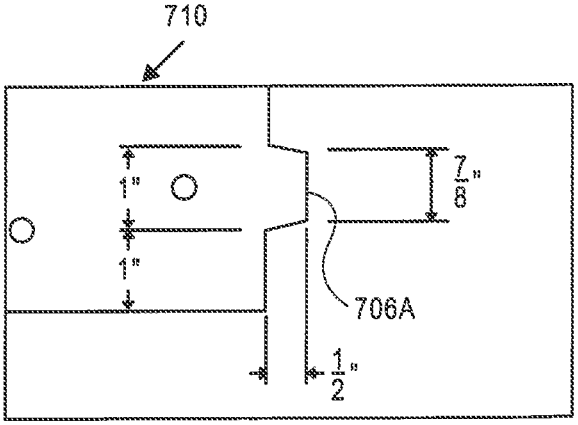

In one embodiment, an interlocking shear key 706A, 706B is located at the lower left and right corners of the connector 700. A connector can be stacked on top of/above another connector, so that shear keys 706A, 706B of the connector on top fit into recesses 707A, 707B located at the upper left and right corners of the connector below. The keys interlock the stacked connector plates together to increase stiffness/performance as if it were one continuous steel plate element. FIG. 7B illustrates typical hole spacing in the connector, according to one embodiment. Fasteners may be inserted through the holes and into the wall panels to affix the connector to the wall panels. FIG. 7C illustrates the shear key dimensions, according to one embodiment.

Figure 8:
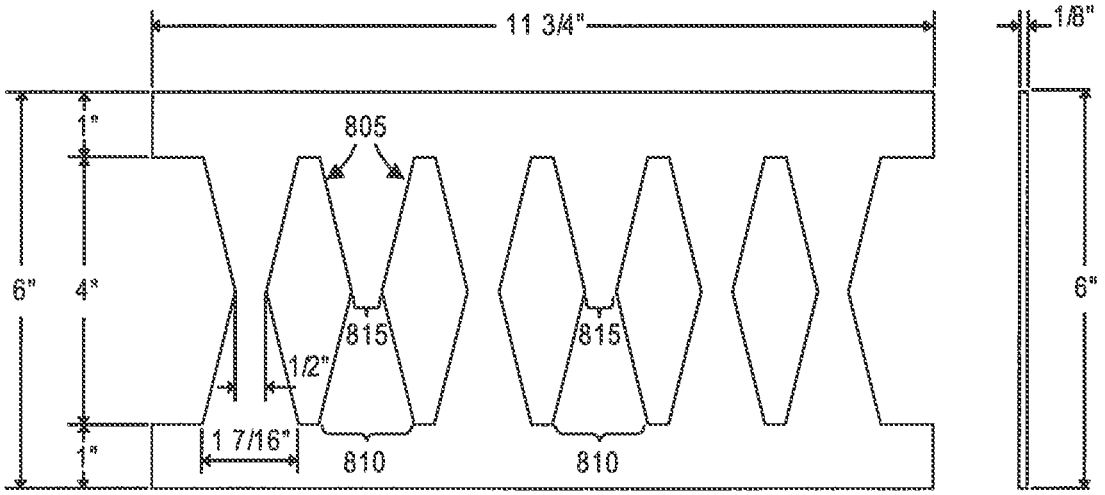
FIG. 8 illustrates an inter-panel connector in accordance with an embodiment of the invention.
Figure 9:
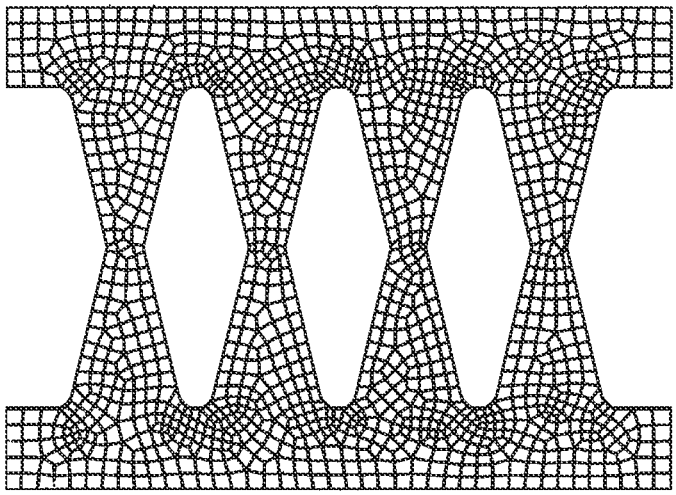
FIG. 9 illustrates a model of the inter-panel connector in accordance with an embodiment of the invention illustrated in FIG. 8.

FIGS. 8 and 9 illustrate a connector 800, and a corresponding finite element model of connector 800, in accordance with another embodiment of the invention, as modeled by the assignee of the present application. In particular, a finite element model 900 of a steel plate connector 800 was generated in ABAQUS, a software suite for finite element analysis and computer-aided engineering, available from Dassault Systems. FIGS. 8 and 9 illustrate tapered leaves in the steel plate connector to provide relatively high stiffness initially, then as the connector is deformed (top displaced parallel to the base), the leaves begin to buckle and yield to provide a low stiffness and large displacement capacity.

Figure 10:
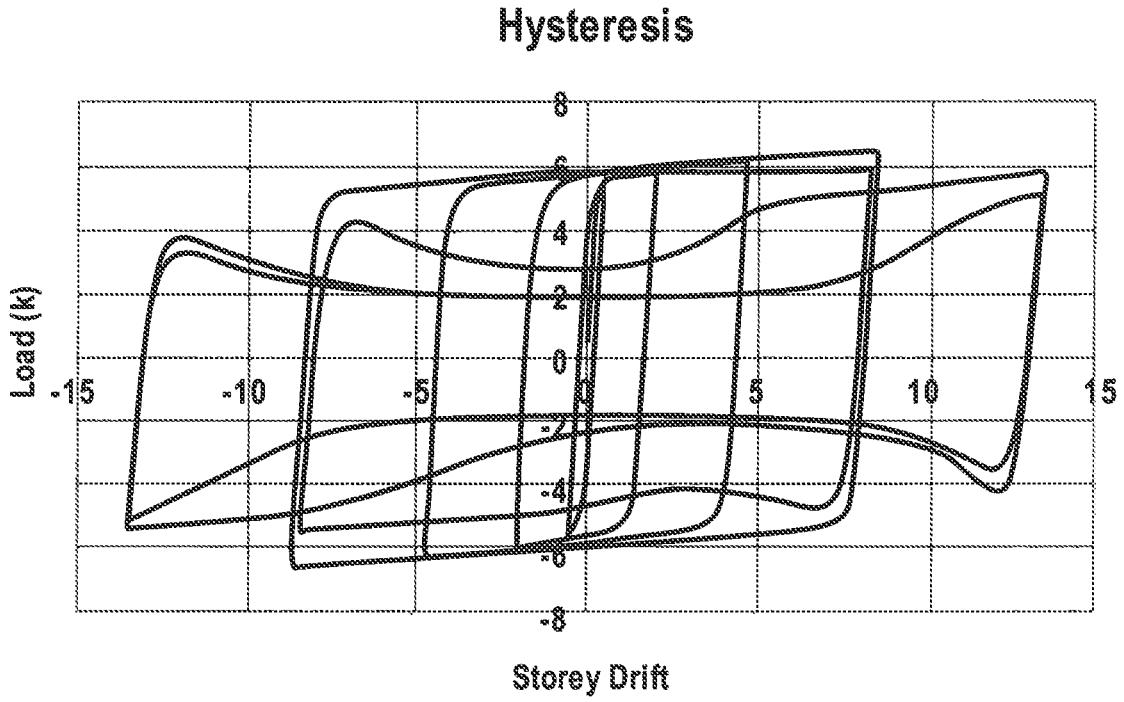
FIG. 10 illustrates a load-deflection curve for an a hysteretic response curve in accordance with the embodiment of the invention illustrated in FIG. 8.

The connector 800 was modeled using ABAQUS in an iterative procedure, with several refinements to improve the overall performance. It is believed that the performance of the connector is dependent on the thickness of the steel plate, the overall length of the individual leaves 805 (4 inches in FIG. 8), the ratio of the base of the leaves 810 to throat of the leaves 815 (1 and 7/16-in/½-in in FIG. 8), and the modulus of elasticity (MOE) and yield strength ($\sigma_y$) of the steel. The load-displacement response of the connector is shown in FIG. 10. The decrease in load resistance illustrated in the larger displacement demand cycles are due to the connector leaves buckling as well as yielding. The model does not include stain hardening or failure characteristics in the material characterization at this time. When the connection is tested on mass timber shear wall panels, the buckling performance will change since the steel plate will only be able to deflect in one direction (away from the panel) in reality, and the model currently does not restrict this deformation.

The above described embodiments, place the connectors on opposing outside faces of the mass wall panels. Under small to medium racking deformations the plate metal elements are stabilized from rotating or buckling out-of-plane by bearing against the wooden panels. At large racking deformations and high strains, the individual metal plate elements are allowed to rotate out of plane. These connectors are depicted as relatively thin, perforated, metal sheets that are attached to the wall segments (i.e., nailed, bolted, or screwed, etc.), at a plurality of locations or otherwise attached or adhesively bonded to adjacent wall panels 105A and 105B. In one embodiment, the metal sheets are comprised of sheet steel product manufactured to ASTM A1011, but the steel alloy can be changed and the relative dimensions of the connector can be modified to compensate for the change in mechanical properties.

Figure 2A:
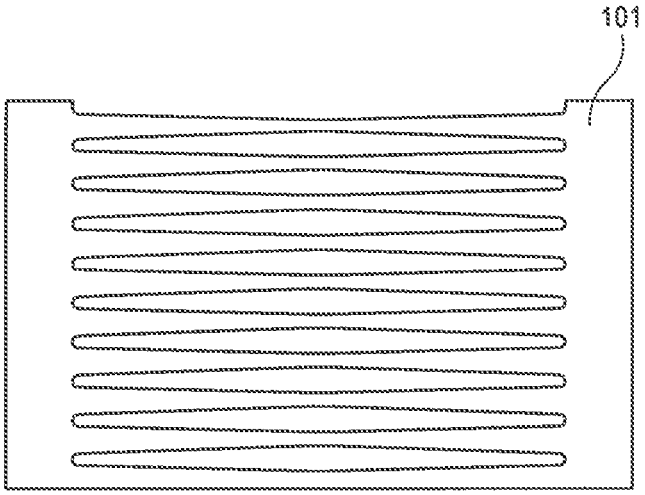
FIG. 2A illustrates a front view of an inter-panel connector in accordance with an embodiment of the invention.
Figure 2B:
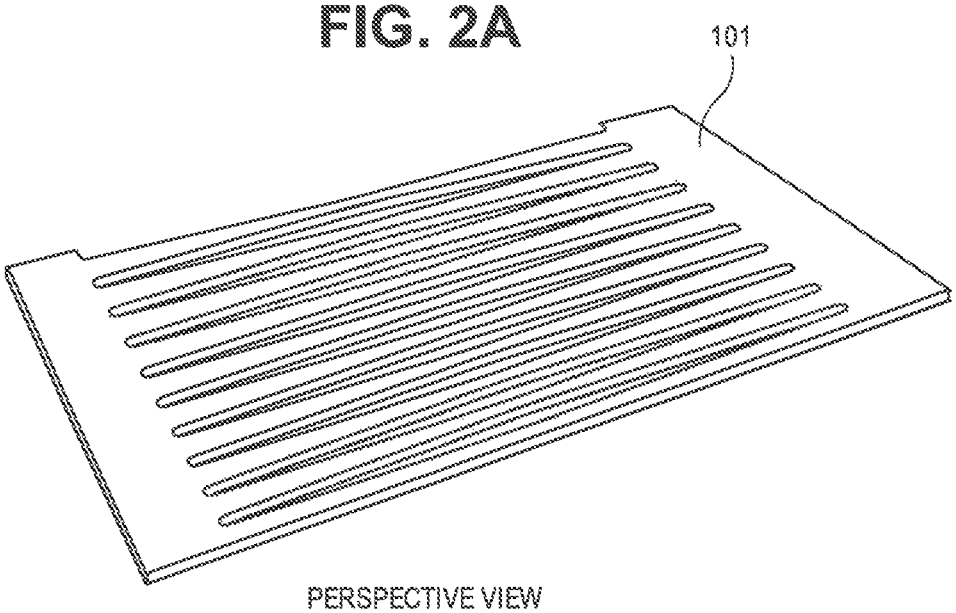
FIG. 2B illustrates a perspective view of the inter-panel connector in accordance with an embodiment of the invention.
Figure 3A:
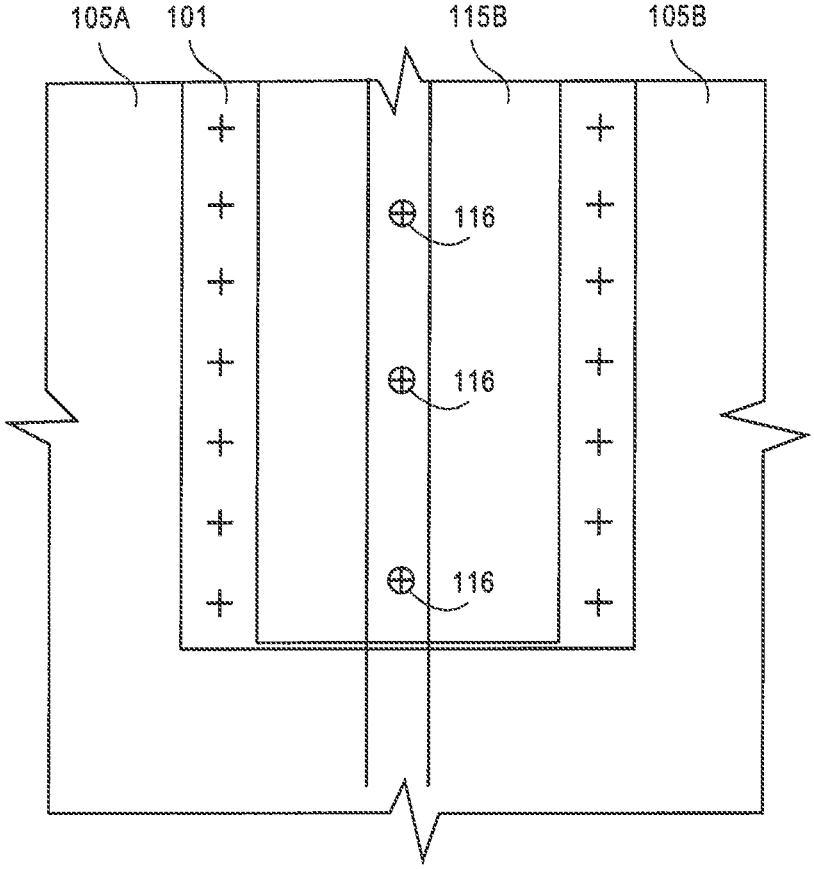
FIG. 3A illustrates an elevation view of a means for fastening an inter-panel connector to adjacent mass timber wall panels in accordance with an embodiment of the invention.
Figure 3B:
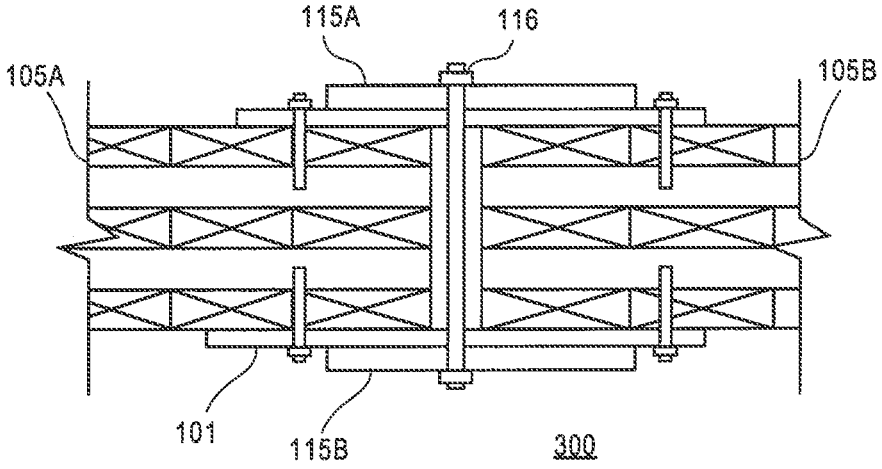
FIG. 3B illustrate a plan view of a means for fastening an inter-panel connector to adjacent mass timber wall panels in accordance with an embodiment of the invention.

An alternative embodiment 200 of a mass timber-to-mass timber wall connector 101 is illustrated in FIGS. 2A (front perspective view), 2B (perspective view), 3A (elevation view), and 3B (plan view). The alternative embodiments sandwich the ductile/dissipative connector 101 between plywood (or similar) cover panels 115A, 115B (not depicted in FIGS. 2A and 2B) on opposing sides of the adjacent panels 105A, 105B. The panels 115A, 115B are through-bolted to each other at 116. In such an embodiment, these cover panels 115A, 115B are thought to restrain out-of-plane connector plate buckling, while at the same time float within the plane of the cover, such that they do not affect the strength/stiffness of the connector 101. A low-friction material, such as Ultra-High-Molecular Weight (UHMW) Polyethylene sheets may be introduced in the sandwich to help reduce friction, for example, between the connector 101 and the cover panel 115. One advantage of the buckle-restrained embodiment illustrated in FIGS. 2A, 2B and 3 is that any non-linear energy dissipation is more stable and deterministic.

Figure 4:
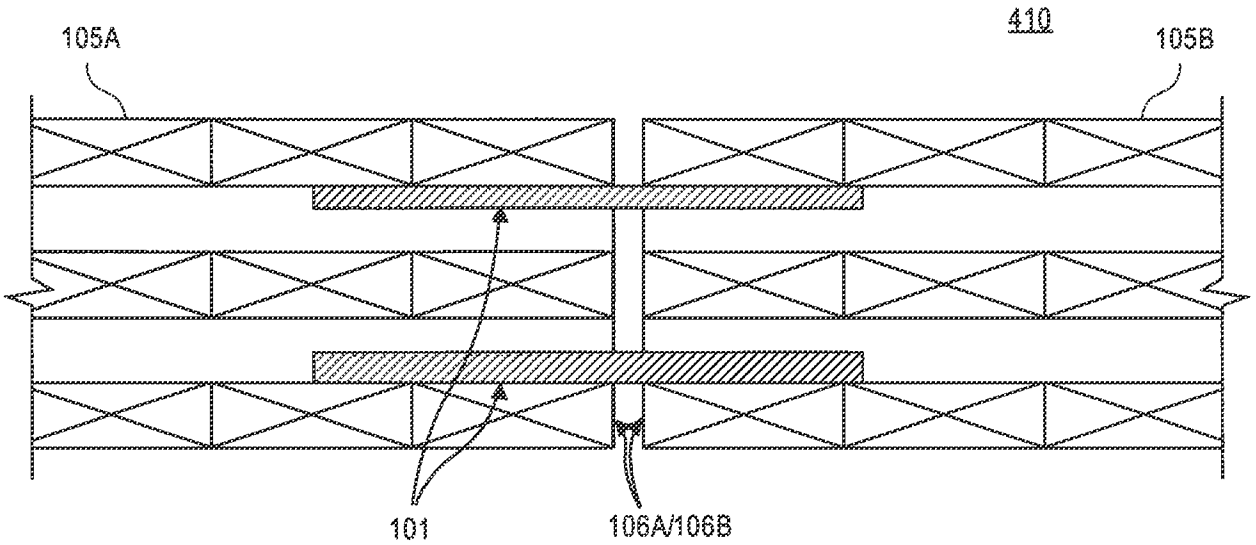
FIG. 4 illustrates a top view of an embodiment of the invention.

In another embodiment 400, with reference to FIG. 4, one or more mass timber-to-mass timber wall connectors 101 are embedded within, and span between, mass timber wall panels 105A, 105B. To accommodate embedding of a connector 101, a volume of panel material at least the dimension of that portion of the connector that is embedded into a respective mass timber wall panel is removed from the mass timber wall panel. In one embodiment, the volume of panel material removed is greater in width, and length of that portion of the connector inserted into the mass timber wall panel, and the depth of the area removed is equal to or greater than the thickness of the connector, to allow for placement of the assembly and to allow for rocking of the mass timber panels while at the same time minimizing deformation or buckling to the connector, for example, during a significant seismic or wind load event. In this embodiment, at small, medium, and large racking deformations the connector elements are prevented from buckling/rotating out-of-plane by being restrained by the wood panel itself, on both sides.

Figure 5:
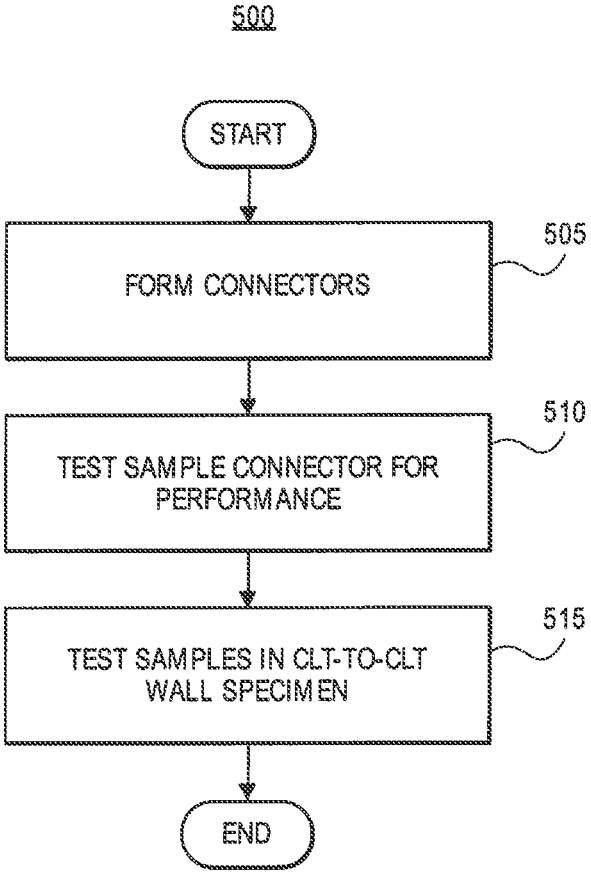
FIG. 5 illustrates a flow chart in accordance with an embodiment of the invention.

According to one embodiment 500, with reference to FIG. 5, a method of manufacturing the connectors is described below. Initial steel sheet is purchased and manufactured into the connectors at step 505. A sample of the connectors is then tested by itself in a universal test machine to quantify the actual load-displacement curves and hysteresis performance of the connector, at step 510. If the sample passes the performance testing, further test sample connectors in a 2-panel mass timber-to-mass timber wall specimen in full-scale at step 515. In one embodiment, this uses several of the connectors to be tested on the wall. It is envisioned that the overall wall specimen would have 8 connectors (4 on each side of the panels 105A, 105B). In one embodiment, the number of connectors is not as significant as the total length of connector per story height of the mass timber wall panels.

A connector according to an embodiment of the invention is envisioned to be developed like a widget, similar to products manufactured by Simpson Strong-Tie. The manufacturer of the connector will pre-qualify through testing a range of suitable connectors. A designer first designs a wall for a building and determines the mass timber panels require a certain amount of shear force capacity on the inter-panel seam for the wall. The designer then specifies how many connectors and what size are required to meet the wall design. It is envisioned that the connectors in various sizes and shapes are available for viewing via website or catalog, and the designer selects a number of connectors of appropriate size and shape. These connectors are then attached to the two panels in the field as the building is being erected. In one embodiment, one or more connectors are attached according to such factors as the dimensions and strength of the connectors, and the dimensions of the mass timber wall panels. In one embodiment, a minimum total cumulative length of the attached connectors, in a vertical direction, is met or exceeded, based on such factors as the dimensions and weight of the mass timber wall panels, and various building codes and zoning codes.

Although embodiments of the invention have been described and illustrated in the foregoing illustrative embodiments, it is understood that present disclosure has been made only by way of example, and that numerous changes in the details of implementation of the invention can be made without departing from the spirit and scope of embodiments of the invention, which is only limited by the claims that follow. Features of the disclosed embodiments can be combined and rearranged in various ways.

What is claimed is:

1. An apparatus to fasten two mass timber shear wall panels together along respective abutted vertical edges of the mass timber shear wall panels, the apparatus comprising:

a first, and a second, generally rectangular steel plate connector respectively attached to an opposing face of the two mass timber shear wall panels, wherein each generally rectangular steel plate connector:

has an initial stiffness in the absence of being subjected to an earthquake;

maintains the initial stiffness when subjected to an earthquake that is less than a service level earthquake or a wind event that is less than an ultimate wind event so that the two mass timber shear wall panels move together as a single body; and decreases in stiffness through ductile deformation of the generally rectangular steel plate connector when subjected to an earthquake that is equal to or greater than the service level earthquake or a wind event that is equal to or greater than the ultimate wind event so that the two mass timber shear wall panels move independently with respect to each other;

a first cover panel placed on an outside face of the first generally rectangular steel plate connector; and a second cover panel placed on an outside face of the second generally rectangular steel plate connector and through-bolted to the first cover panel.

2. The apparatus of claim 1, wherein the service level earthquake comprises ground shaking represented by an elastic, 2.5%-damped, acceleration response spectrum that has a mean return period of 43 years, approximately equivalent to a 50% exceedance probability in 30 years.

3. The apparatus of claim 1, wherein the ultimate wind loading event comprises a wind loading event with an ultimate 3-second gust wind speed.

4. The apparatus of claim 1, wherein a measure of a displacement of the two mass timber shear wall panels when the two mass timber shear wall panels move independently with respect to each other is in a range of 4-6% of lateral displacement per height of the two mass timber shear wall panels.

5. The apparatus of claim 1 wherein each generally rectangular steel plate connector, when subjected to the earthquake that is equal to or greater than service level earthquake or a wind event that is equal to or greater than ultimate wind event so that the two mass timber shear wall panels move independently with respect to each other, achieves a low stiffness plastic state that allows each of the two mass timber shear wall panels to rotate or rock about a respective base connection point.

6. The apparatus of claim 1, wherein each generally rectangular steel plate connector that decreases in stiffness through ductile deformation of the generally rectangular steel plate connector decreases in stiffness by buckling to allow each of the two mass timber shear wall panels to rotate or rock about a respective base connection point.

7. The apparatus of claim 1, wherein each generally rectangular steel plate connector is fastened to each of the two mass timber shear wall panels by one or more of a plurality of nails, bolts, screws, and an adhesive bond.

8. The apparatus of claim 1, wherein each generally rectangular steel plate connector achieves a clearly defined load at which the generally rectangular steel plate connector changes from the initial stiffness to the decreased stiffness to allow displacement of a wall comprising mass timber shear wall panels connected together with the generally rectangular steel plate connector when subjected to the earthquake that is equal to or greater than the service level earthquake or the wind event that is equal to or greater than the ultimate wind event.

9. The apparatus of claim 8, wherein the clearly defined load is a proportional limit of the generally rectangular steel plate connector where a linear-elastic yield strain of metal in the generally rectangular steel plate connector is attained and beyond which a non-linear inelastic strain develops in the metal of the generally rectangular steel plate connector.

10. The apparatus of claim 9, wherein the proportional limit of the generally rectangular steel plate connector is a force level of approximately 2 kips.

11. The apparatus of claim 1, wherein each generally rectangular steel plate connector that decreases from the initial stiffness through ductile deformation of the generally rectangular steel plate connector comprises steel leaves in the generally rectangular steel plate connector that provide the initial stiffness in the generally rectangular steel plate connector beginning to buckle and yield to provide the decrease in stiffness in the generally rectangular steel plate connector.

12. The apparatus of claim 1, wherein each generally rectangular steel plate connector has a plurality of generally parallel slots, and wherein each of the plurality of generally parallel slots of the generally rectangular steel plate connector has a width at a midpoint of the slot that is greater than a width at either of an end of the slot by which the slot is tapered from the midpoint to either end of the slot, and wherein the generally rectangular steel plate connector having the initial stiffness that decreases through ductile deformation of the generally rectangular steel plate connector comprises the generally rectangular steel plate connector having the initial stiffness that decreases through buckling of the generally rectangular steel plate connector about the plurality of generally parallel slots of the generally rectangular steel plate connector.

13. The apparatus of claim 1, wherein each generally rectangular steel plate connector has a plurality of generally parallel slots, wherein the plurality of generally parallel slots of the generally rectangular steel plate connector are oriented horizontally, and wherein the generally rectangular steel plate connector that fastens the two mass timber shear wall panels together along respective abutted vertical edges of the mass timber shear wall panels is positioned such that the abutted vertical edges of the mass timber shear wall panels are at a midpoint of each of the plurality of generally parallel slots of the generally rectangular steel plate.

14. An apparatus to fasten two mass timber shear wall panels together along respective abutted vertical edges of the mass timber shear wall panels, the apparatus comprising:

a first, and a second, generally rectangular steel plate connector respectively attached to opposing faces of the two mass timber shear wall panels, that:

has a plurality of generally parallel slots, each having a width at a midpoint of the slot that is greater than a width at either of an end of the slot by which the slot is tapered from the midpoint to either end of the slot;

has an initial stiffness in the absence of being subjected to an earthquake; maintains the initial stiffness when subjected to an earthquake that is less than a service level earthquake or a wind event that is less than an ultimate wind event so that the two mass timber shear wall panels move together as a single body; and decreases in stiffness through buckling of the generally rectangular steel plate connector about the plurality of generally parallel slots of the generally rectangular steel plate connector when subjected to an earthquake that is equal to or greater than the service level earthquake or wind event that is equal to or greater than the ultimate wind event so that the two mass timber shear wall panels move independently with respect to each other;

a first cover panel placed on an outside face of the first generally rectangular steel plate connector; and a second cover panel placed on an outside face of the second generally rectangular steel plate connector and through-bolted to the first cover panel.

15. An apparatus to fasten two adjacent mass timber shear wall panels together, the apparatus comprising:

a first, and a second, generally rectangular steel plate connector, a respective first portion thereof embedded within a first of the two adjacent mass timber shear wall panels, and a respective second portion thereof embedded within a second of the two adjacent mass timber shear wall panels, wherein each generally rectangular steel plate connector:

has an initial stiffness in the absence of being subjected to an earthquake;

maintains the initial stiffness when subjected to an earthquake that is less than a service level earthquake or a wind event that is less than an ultimate wind event so that the two mass timber shear wall panels move together as a single body; and decreases in stiffness through ductile deformation of the generally rectangular steel plate connector when subjected to an earthquake that is equal to or greater than the service level earthquake or a wind event that is equal to or greater than the ultimate wind event so that the two mass timber shear wall panels move independently with respect to each other.

16. The apparatus of claim 15, wherein a volume of panel material at least the dimension of the first portion of the respective generally rectangular steel connector embedded within the first mass timber shear wall panel is removed from the first mass timber shear wall panel, and wherein the first portion of the respective generally rectangular steel plate connector embedded within the first mass timber shear wall panel, comprises the first portion of the respective generally rectangular steel plate connector embedded within the removed volume of panel material in the respective mass timber wall panel.

17. The apparatus of claim 16, wherein the volume of panel material that is removed from the first mass timber shear wall panel comprises a removed volume of panel material greater in width, and length of the first portion of the generally rectangular steel plate connector embedded within the mass timber sheer wall panel.

18. The apparatus of claim 17, wherein a depth of the volume of panel material that is removed from the first mass timber shear wall panel is equal to or greater than a thickness of the generally rectangular steel plate connector.

* * * * *